US006374820B1

(12) United States Patent
Sakamoto et al.

(10) Patent No.: US 6,374,820 B1
(45) Date of Patent: Apr. 23, 2002

(54) MANUFACTURING METHOD FOR MONOLITHIC CERAMIC PART AND CUTTING DEVICE FOR CERAMIC LAMINATE

(75) Inventors: Yoshinori Sakamoto, Sabae; Shizuma Tazuke; Haruhiko Mori, both of Takefu, all of (JP)

(73) Assignee: Murata Manufacturing Co., LTD (JP)

( * ) Notice: Subject to any disclaimer, the term of this patent is extended or adjusted under 35 U.S.C. 154(b) by 0 days.

(21) Appl. No.: 09/670,650

(22) Filed: Sep. 27, 2000

(30) Foreign Application Priority Data

Sep. 30, 1999 (JP) ..... 11-279031

(51) Int. Cl.[7] ..... B28D 1/04
(52) U.S. Cl. ..... 125/23.02
(58) Field of Search ..... 125/23.02, 23.01

(56) References Cited

U.S. PATENT DOCUMENTS 4,806,295 A * 2/1989 Trickett et al. ..... 264/59
5,248,640 A * 9/1993 Sano et al. ..... 501/138
5,331,877 A * 7/1994 Ishii ..... 83/886

* cited by examiner

*Primary Examiner*—Joseph J. Hail, III
*Assistant Examiner*—David B. Thomas
(74) *Attorney, Agent, or Firm*—Ostrolenk, Faber, Gerb & Soffen, LLP

(57) ABSTRACT

A manufacturing method for a monolithic ceramic part permitting a ceramic laminate to be cut stably and speedily, even if the thickness of the ceramic laminate is large. In order to divide a mother ceramic laminate into individual laminates of monolithic ceramic part units, the ceramic laminate is cut with a cutting blade, using a pair of guides disposed on opposite sides of the cutting blade in the vicinity of one principal plane of the ceramic laminate to control the cutting direction, and then individual ceramic laminates thus obtained by cutting are fired.

18 Claims, 8 Drawing Sheets

MANUFACTURING METHOD FOR MONOLITHIC CERAMIC PART AND CUTTING DEVICE FOR CERAMIC LAMINATE

BACKGROUND OF THE INVENTION

1. Field of the Invention

The present invention relates to a method for manufacturing a monolithic ceramic part such as a monolithic capacitor, and a cutting device used for cutting an unfired ceramic laminate when manufacturing the monolithic ceramic part.

2. Description of the Related Art

In order to manufacture a monolithic ceramic electronic part such as monolithic capacitor, first a mother ceramic laminate composed of stacked mother ceramic green sheets and including inner electrodes is obtained. Next, as shown in FIG. 12, the mother laminate 51 is cut with a cutting blade 52 into individual ceramic laminates of monolithic capacitor units. Typically a thin cutting blade 52 with a thickness of about 0.05 mm to 0.3 mm is used in order to cut the mother ceramic laminate 51 with a high degree of accuracy.

The cutting blade 52 is held by a holder 53, and the holder 53 is coupled to a driving source (not shown). After cutting, the mother ceramic laminate 51 is moved in direction A (marked with an arrow in FIG. 12), or the holder is moved in direction B (also marked with the arrow in the figure), and the mother ceramic laminate 52 is cut at next portion thereof. Then, the mother ceramic laminate 51 is rotated 90, and the mother ceramic laminate 51 is cut in a like manner, in a direction orthogonal to the direction in which it was previously cut.

Thereafter, individual ceramic laminates of monolithic capacitor units thus obtained are fired to obtain ceramic sintered bodies. By providing outer electrodes to opposite end faces of each of the sintered bodies, monolithic capacitors are obtained.

In order to achieve size-reduction in the monolithic capacitor electronic parts, the thickness of each ceramic layer sandwiched between inner electrodes must be decreased with the result that the number of inner electrode layers must be increased. Also, a size-reduction in planar dimensions of footprint of the monolithic capacitor is desired to enhance the surface mounting density of a circuit board, which results in the increasing in the overall thickness of the ceramic laminate.

When trying to cut a ceramic laminate of which the number of laminated inner electrode layers is increased, or of which thickness is increased, the cutting blade 52 is inevitably subjected to high cutting resistance.

As a result, although a high speed cutting is needed in order to increase productivity, an increased speed does not permit the stable cutting of the mother ceramic laminate 51 in the direction orthogonal to the principal plane 51*a* thereof.

Also, since the cutting blade 52 is thin, once cutting resistance grows, the cutting blade 52 can be bent as it moves across the mother ceramic laminate 51, as shown in FIG. 13, even though the cutting blade 52 enters the mother ceramic laminate 51 in the direction orthogonal to the principal plane 51*a* thereof. As a result, the cut face obtained by cutting the ceramic laminate can be tilted, and in an extreme case, inner electrodes 54 will be undesirably exposed.

This has constituted a problem not only in the monolithic ceramic electronic part, but also in the other monolithic ceramic parts that are obtained by laying up a plurality of ceramic green sheets and firing them. That is, since the resistance to the cutting blade increases with the number of laminated sheets, stable cutting of the mother ceramic laminate cannot be achieved at an increased speed.

SUMMARY OF THE INVENTION

Accordingly, it is an object of the present invention to provide a manufacturing method for a monolithic ceramic part, having the step of speedily and stably cutting a ceramic laminate even if the number of laminations is increased, and provide a cutting device for a ceramic laminate used in the above-mentioned manufacturing method.

The manufacturing method for a monolithic ceramic part in accordance with the present invention comprises preparing an unfired mother ceramic laminate; dividing the mother ceramic laminate into individual laminates of monolithic ceramic part units by cutting the mother ceramic laminate with a cutting blade extending through guides disposed on opposite sides of the cutting blade and being located in the vicinity of one planar principal surface of the mother ceramic laminate to control the cutting direction of the blade; and firing individual ceramic laminates obtained by the cutting operation.

Preferably, cutting is performed while keeping the above-mentioned guides abutted against the one principal plane of the mother ceramic laminate.

In accordance with one aspect of the present invention, the cutting blade is detached from the ceramic laminate after cutting while keeping the guides abutted against the planar principal surface of the mother ceramic laminate.

In accordance with another aspect of the present invention, cutting is performed with a clearance provided between the guides and the cutting blade.

In accordance with still another aspect of the present invention, the guides each have tilted guide faces tilted relative to the sides of the cutting blade, and thereby the cutting direction is tilted from a direction orthogonal to the planar principal surface of the mother ceramic laminate.

The cutting device for use in a ceramic laminate in accordance with the present invention is a cutting device for cutting a ceramic laminate, comprising: a cutting blade; a drive connected to the cutting blade so as to move the cutting blade in a thickness direction of the ceramic laminate in order to cut said ceramic laminate in the thickness direction thereof; and guides disposed on opposite sides of the cutting blade in the vicinity of the ceramic laminate in order to control the direction that the cutting blade enters the ceramic laminate.

In one aspect of the cutting device for use in a ceramic laminate in accordance with the present invention, there are further provided first actuators, each connected to a respective guide, in order to move at least one of said guides toward said cutting blade. A single actuator connected to one of the guides can also be used.

In another aspect of the cutting device for use in a ceramic laminate in accordance with the present invention, there is further provided a base member having a lower surface on which the cutting blade is fixed, and which can be moved in the upper and lower directions by the drive; and second actuators which are coupled to the lower surface of the base member, and which are each connected to the guides so as to move the guides in the upper and lower directions independently of the base member.

In still another aspect of the cutting device for use in a ceramic laminate in accordance with the present invention, the guides each have guide faces for controlling the cutting direction of the cutting blade, and the guide faces are each formed to be tilted relative to the thickness direction of the ceramic laminate in order to cut the ceramic laminate in the direction intersecting the thickness direction of the ceramic laminate.

BRIEF DESCRIPTION OF THE DRAWINGS

Other features and advantages of the present invention will become apparent from the following description of the invention which refers to the accompanying drawings.

DETAILED DESCRIPTION OF EMBODIMENTS OF THE INVENTION

Figure 1:
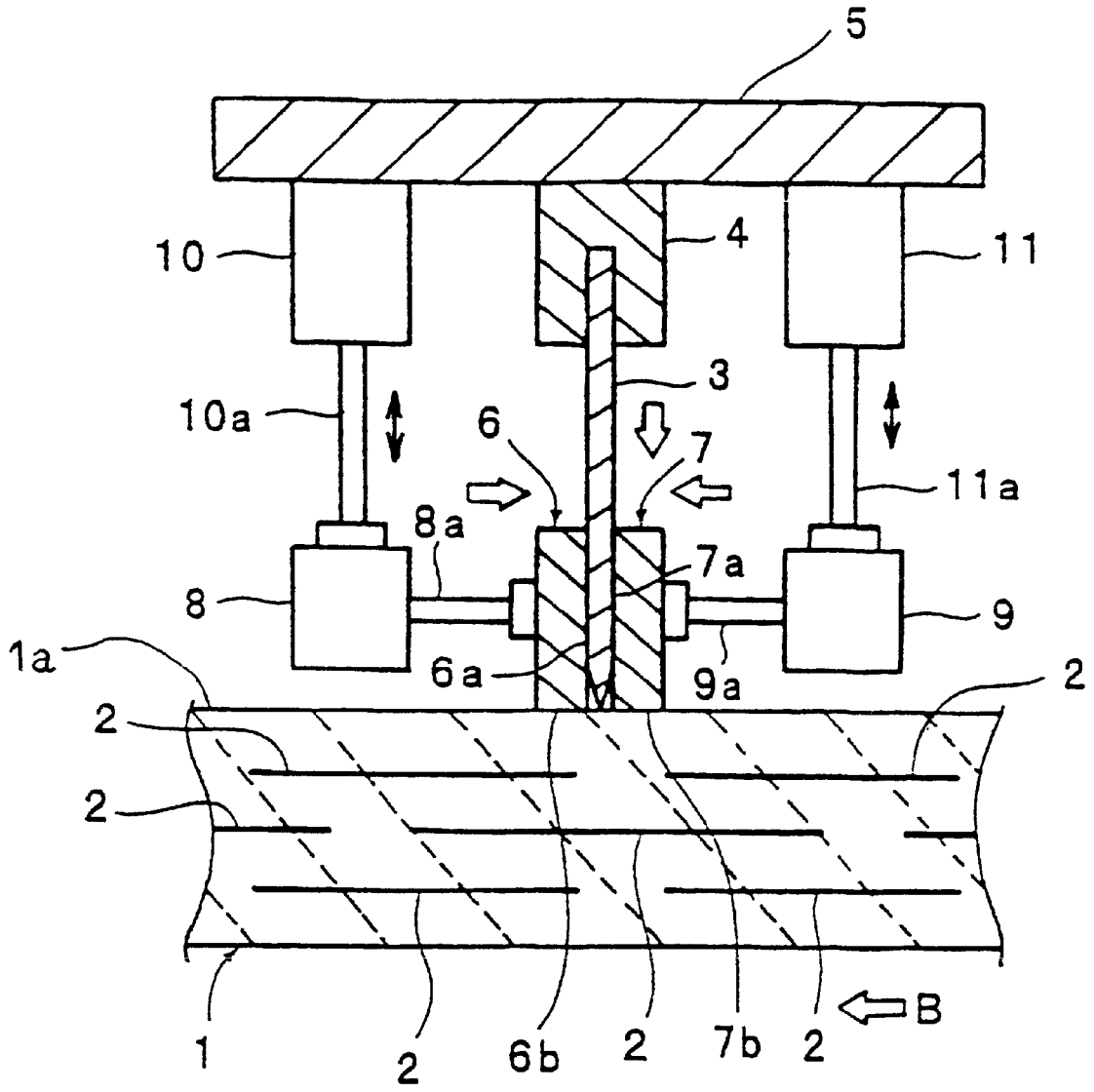
FIG. 1 is a cross sectional view for explaining the cutting device in accordance with a first embodiment of the present invention.

FIG. 1 is a diagram showing a preferred embodiment of a cutting device constructed in accordance with the principles of the present invention. Using this cutting device, one embodiment of the manufacturing method for a monolithic ceramic part in accordance with the present invention will be described hereinbelow. In the present embodiment, the monolithic ceramic part is a monolithic capacitor.

First, an unfired mother ceramic laminate 1 is prepared. Within the ceramic laminate 1, a plurality of inner electrode patterns 2 are embedded in parallel with one planar principal surface 1*a* of the laminate 1. The plurality of inner electrode patterns 2 are superimposed one above another in the thickness direction of the ceramic laminate 1 via ceramic layers.

In order to divide the mother ceramic laminate 1 into individual laminates of monolithic capacitor units, a cutting device having a cutting blade 3 constituted of metal or the like with a thickness of about 0.05 mm to 0.3 mm is used. The cutting blade 3 is held by a holder 4 around the upper end thereof. The holder 4 is fixed to the lower surface of the base member 5.

A pair of guides 6 and 7 are disposed on opposite sides of the cutting blade 3. The guides 6 and 7 have respective guide faces 6*a* and 7*a* for controlling the cutting direction of the cutting blade 3. The guide faces 6*a* and 7*a* are parallel to each other, and extend in the direction orthogonal to the principal plane 1*a* of the mother ceramic laminate 1. Although not clearly shown in FIG. 1, the guides 6 and 7 extend from the plane of the FIG. 1 rearwardly.

The guides 6 and 7 are fixed to the ends of rods 8*a* and 9*a* of the first actuators 8 and 9, respectively. Each of the actuators 8 and 9 may be a hydraulic cylinder, an air cylinder, a solinoid or the like, and can reciprocate the rods 8*a* and 9*a*, respectively. In FIG. 1, the rods 8*a* and 9*a* are extended, and the guide faces 6*a* and 7*a* of the guides 6 and 7 abut against the sides of the cutting blade 3.

The first actuators 8 and 9 are fixed to the ends of the respective rods 10*a* and 11*a* of the second actuators 10 and 11, at the upper surfaces thereof. The second actuators 10 and 11 are constructed so as to move the respective rods 10*a* and 11*a* up and down, and may be a hydraulic cylinder, an air cylinder, a solinoid, or the like. The second actuators 10 and 11 are fixed to the lower surface of the base member 5. The first actuator 8 and 9, and the guides 6 and 7, therefore, can be moved up and down by the second actuators 10 and 11 independently of the base member 5.

Next, the step of cutting the mother ceramic laminate 1 using the above-described cutting device will be described with reference to FIGS. 1 through 4.

Figure 2:
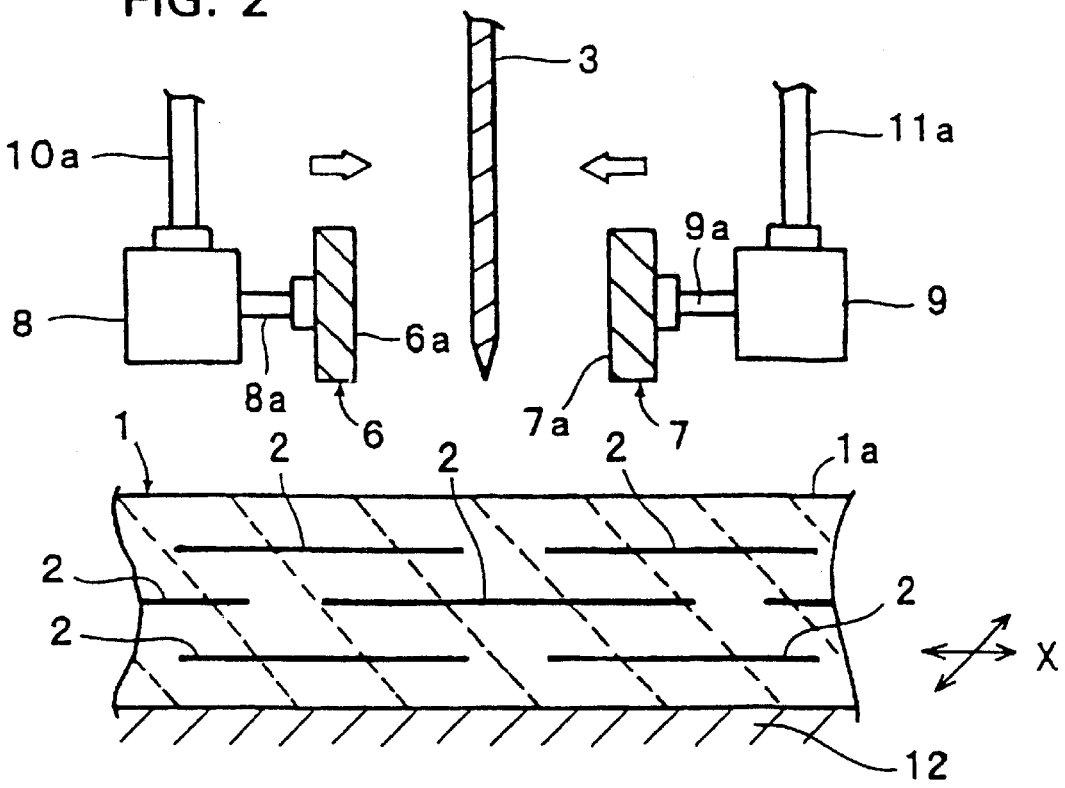
FIG. 2 is a cross sectional view explaining the step of cutting a mother ceramic laminate using the cutting device in accordance with the first embodiment, in which the initial state of this step is shown.

First, a mother ceramic laminate 1 is placed on a stage 12, as shown in FIG. 2. The stage 12 is constructed so as to be moved by a driving source (not shown) in, for example, the X direction marked with an arrow in the figure.

Figure 3:
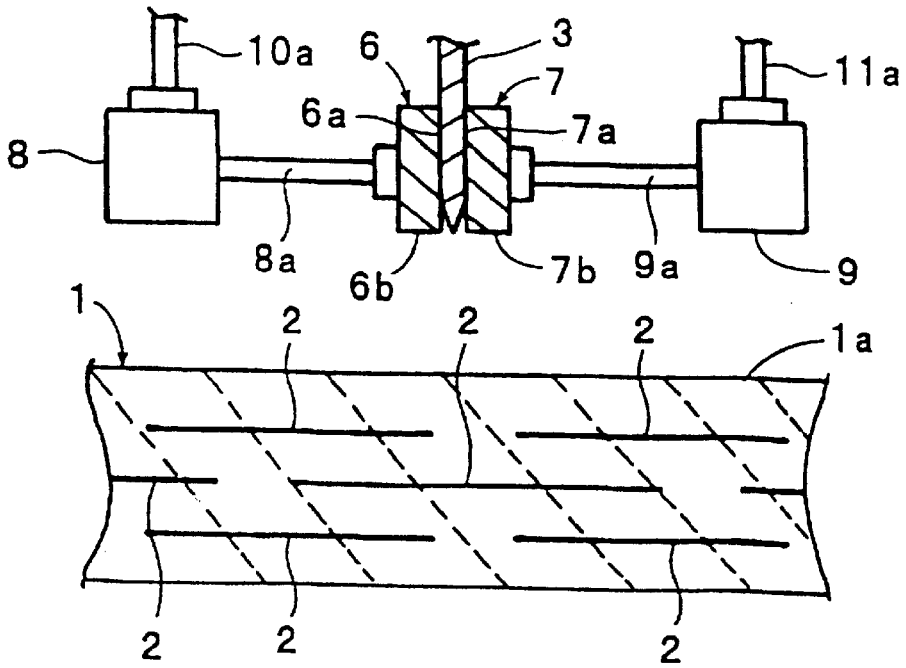
FIG. 3 is a cross sectional view showing the step of abutting a pair of guides against the sides of the cutting blade in which a state following that shown in FIG. 2 is illustrated.
Figure 4:
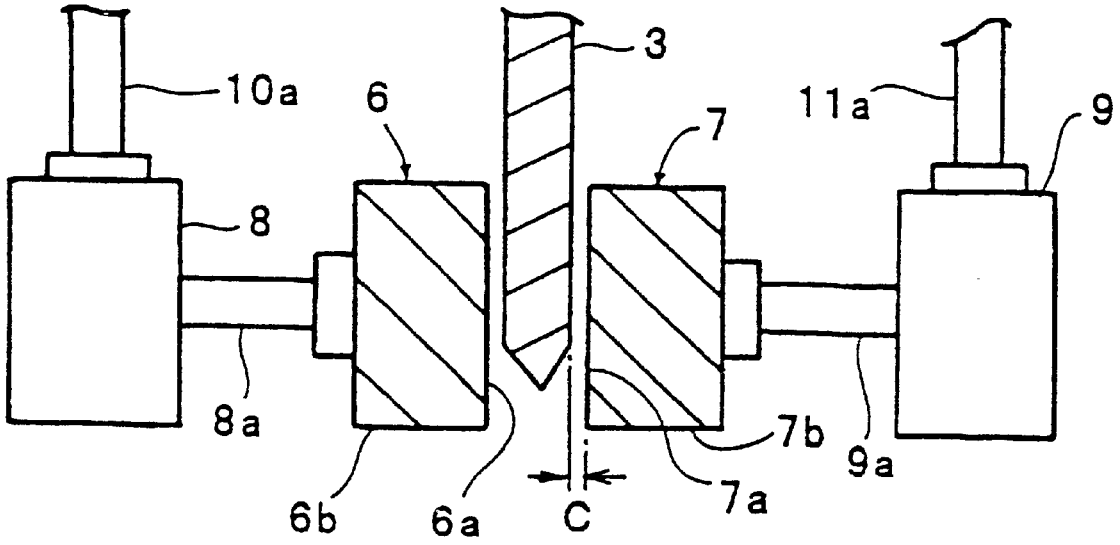
FIG. 4 is a partially cutaway sectional view showing the state in which a clearance C is provided between the cutting blade and the guide.

In the initial state, the guides 6 and 7 are each spaced apart from the sides of the cutting blade 3. The first actuators 8 and 9 are then driven to move the respective guides 6 and 7 toward the cutting blade 3 until the guide faces 6*a* and 7*a* abut against the sides of the cutting blade 3 as shown in FIG. 3. In order to decrease cutting resistance, it is preferable that the guide faces 6*a* and 7*a* lightly contact the sides of the cutting blade 3 so as to avoid any significant pressure contact therewith. Alternatively, in order to reduce rubbing resistance between the cutting blade 3 and the guide faces 6*a* and 6*b*, a clearance C, as shown in FIG. 4, may be provided between the guide faces 6*a* and 7*a* and the cutting blade 3.

On the other hand, too large a clearance C reduces cutting accuracy. For this reason, the clearance C should be selected as a function of the intended cutting accuracy. If a high degree of precision is required, the guide faces 6*a* and 7*a* should abut against or be in intimate contact with the sides of the cutting blade 3, as described above. That is, the clearance may be zero.

The guide faces 6*a* and 7*a* may be brought into contact with the cutting blade 3 using any suitable mechanism as an alternative to the actuators 8 and 9. For example, the guides 6 and 7 may be magnetic or vacuum suction or screws could be used.

Once the guide faces are in place, the base member 5 is lowered and the mother ceramic laminate 1 is cut with the cutting blade 3 (FIG. 1). In this case, the second actuators 10 and 11 are driven so that the cutting blade 3 is lowered while maintaining the lower surfaces 6*b* and 7*b* of the guides 6 and 7 in abutment against the planar principal surface la of the mother ceramic laminate 1. In other words, the second actuators 10 and 11 are constructed so that after the lower surfaces 6*b* and 7*b* of the guides 6 and 7 abut the principal plane 1*a*, the cutting blade 3 can be lowered further while the guides 6 and 7 stay in contact with the surface 1*a*. It is preferable that the second actuators 10 and 11 be constructed so that the rods 10*a* and 11*a* are retracted into the second actuators 10 and 11 as the base member 5 is lowered.

The cutting blade 3 enters the mother ceramic laminate 1 with its cutting direction controlled by the guide faces 6*a* and 7*a*. Therefore, even if the cutting blade 3 is thin, or the mother ceramic laminate 1 is thick, the ceramic laminate 1 can be stably cut with the cutting blade 3. In the present cutting device, since the cutting by the cutting blade 3 can be more stably performed than with the conventional cutting device, it is possible to improve the cutting speed.

In the present embodiment, once the above-described cutting has been completed, the base member 5 is moved upward, and the cutting blade 3 is detached from the mother laminate 1. When the second actuators 10 and 11 are driven to detach the cutting blade 3, the lower surfaces 6*b* and 7*b* of the guides 6 and 7 are maintained in pressure contact with the principal surface 1*a*. That is, the rods 10*a* and 11*a* of the second actuators 10 and 11 are extended, and the cutting blade 3 is detached from the mother ceramic laminate 3 while the lower surfaces 6b and 7*b* of the guides 6 and 7 are maintained in pressure contact with the surface 1*a*.

This prevents peeling-off of ceramic green sheets or the like at the upper part of a cut end face when detaching the cutting blade 3 from the mother ceramic laminate 1. The guides 6 and 7 prevent the adhesion of the ceramic material to the cutting blade 3 and preventing the pulling-up of the ceramic layers. The cutting of the mother ceramic laminate 1, therefore, can be performed faster and more stably. After the mother ceramic laminate 1 has been cut with the cutting blade 3 in the manner described above, the mother laminate 1 is moved in direction B marked with the arrow mark in FIG. 1, and next cutting operation is performed. Specifically, in succession, the mother ceramic laminate 1 is moved along direction B marked with the arrow, and is cut with the cutting blade. Thereafter, the stage 12 is rotated 90, and the mother ceramic laminate 1 is again cut with the cutting blade 3 in the direction orthogonal to the above-mentioned cutting direction.

Once the cutting has been completed in the manner described above, individual unfired ceramic laminates of monolithic capacitor units can be obtained from the mother ceramic laminate 1. By firing the ceramic laminates obtained, ceramic sintered bodies are obtained. Forming a pair of electrodes on opposite end faces of each of these ceramic sintered bodies provides a monolithic capacitor.

The firing step and the outer electrode forming step after the individual unfired ceramic laminates of monolithic capacitor units have been obtained, may be executed by the well-known conventional manufacturing method for a monolithic capacitor.

Figure 5:
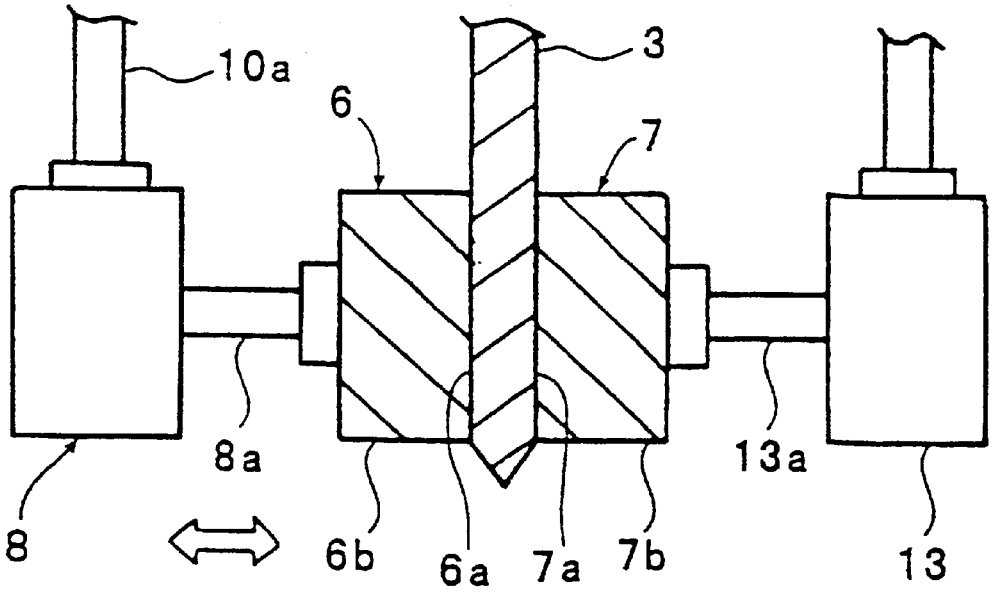
FIG. 5 is a partially cutaway sectional view showing a variant example of the present invention in which one of the pair of guides is connected to the first actuator for lateral movement and the other guide is fixed in place.

In the above-described embodiment, both of guides 6 and 7 are movable. Alternatively, one guide, e.g., guide 7, may be movable and the other stationary (connected to a stationary connecting member 13), as shown in FIG. 5. In this case, the guide face 7*a* of the guide 7 will abut against one side of the cutting blade 3, and the guide face 6*a* of the other guide 6 moved into and out of contact with (or slightly spaced from) the other side of the cutting blade 3 by the actuator 8.

Figure 6:
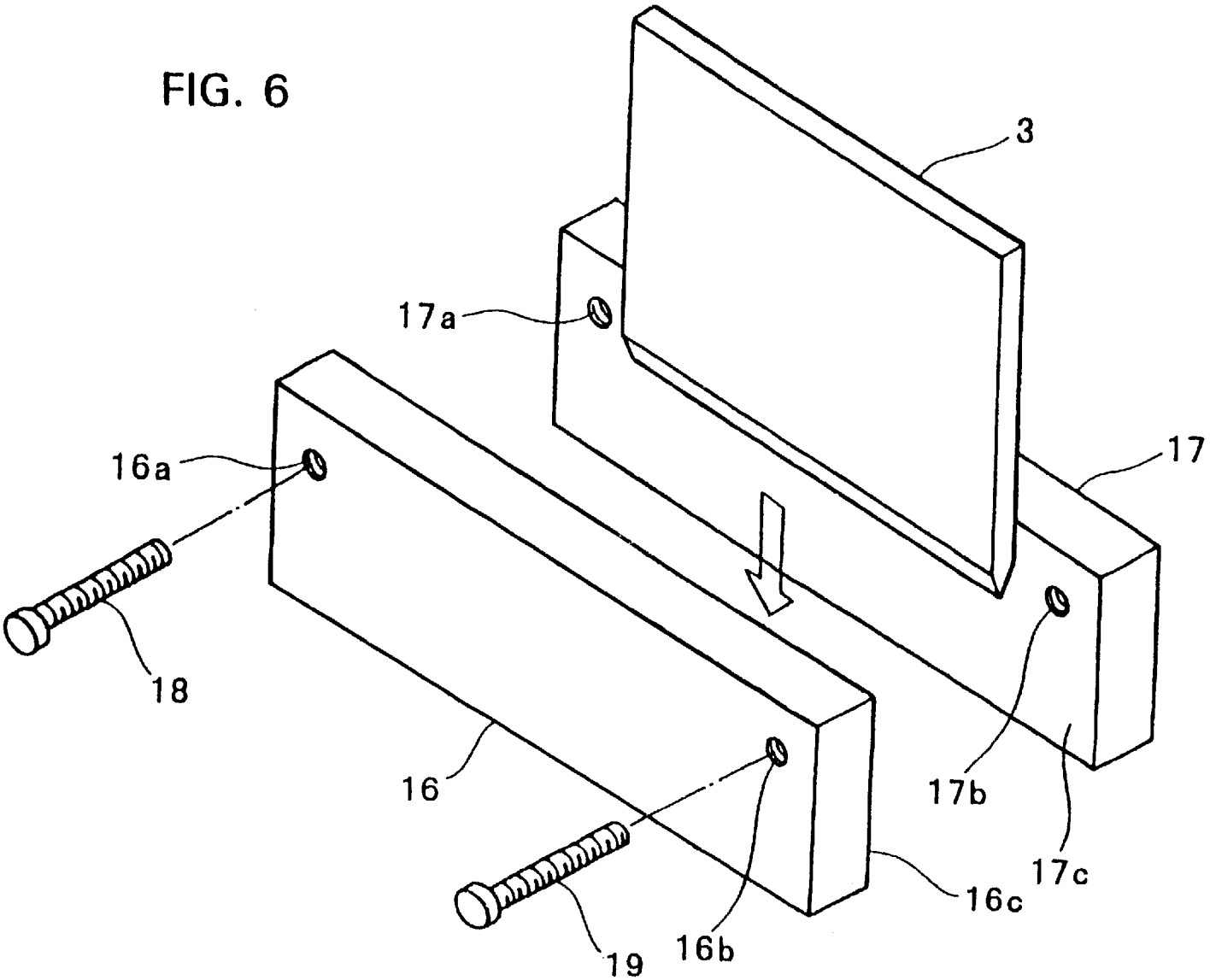
FIG. 6 is an exploded perspective view for explaining the relationship between the cutting blade and the pair of guides in the first embodiment.

In FIG. 6, there is shown a variant example of the guides 6 and 7 and the cutting blade 3 in the form of an exploded perspective view. The guides 16 and 17 may be unified by coupling screws 18 and 19 as shown in FIG. 6. Here, screw holes 16*a*, 16*b*, 17*a*, and 17*b* are formed in the vicinity of both ends of the guides 16 and 17. The coupling screw 18 is screwed into the screw holes 16*a* and 17*a*, and the coupling screw 19 is screwed into the screw holes 16*b* and 17*b*. The cutting blade 3 is inserted between the guides 16 and 17. By adjusting the coupling screws 18 and 19, the distance between the guide faces 16*c* and 17*c* of the guides 16 and 17 can be kept constant. Also, the cutting blade 3 may be pinched by the guides 16 and 17.

Figure 7:
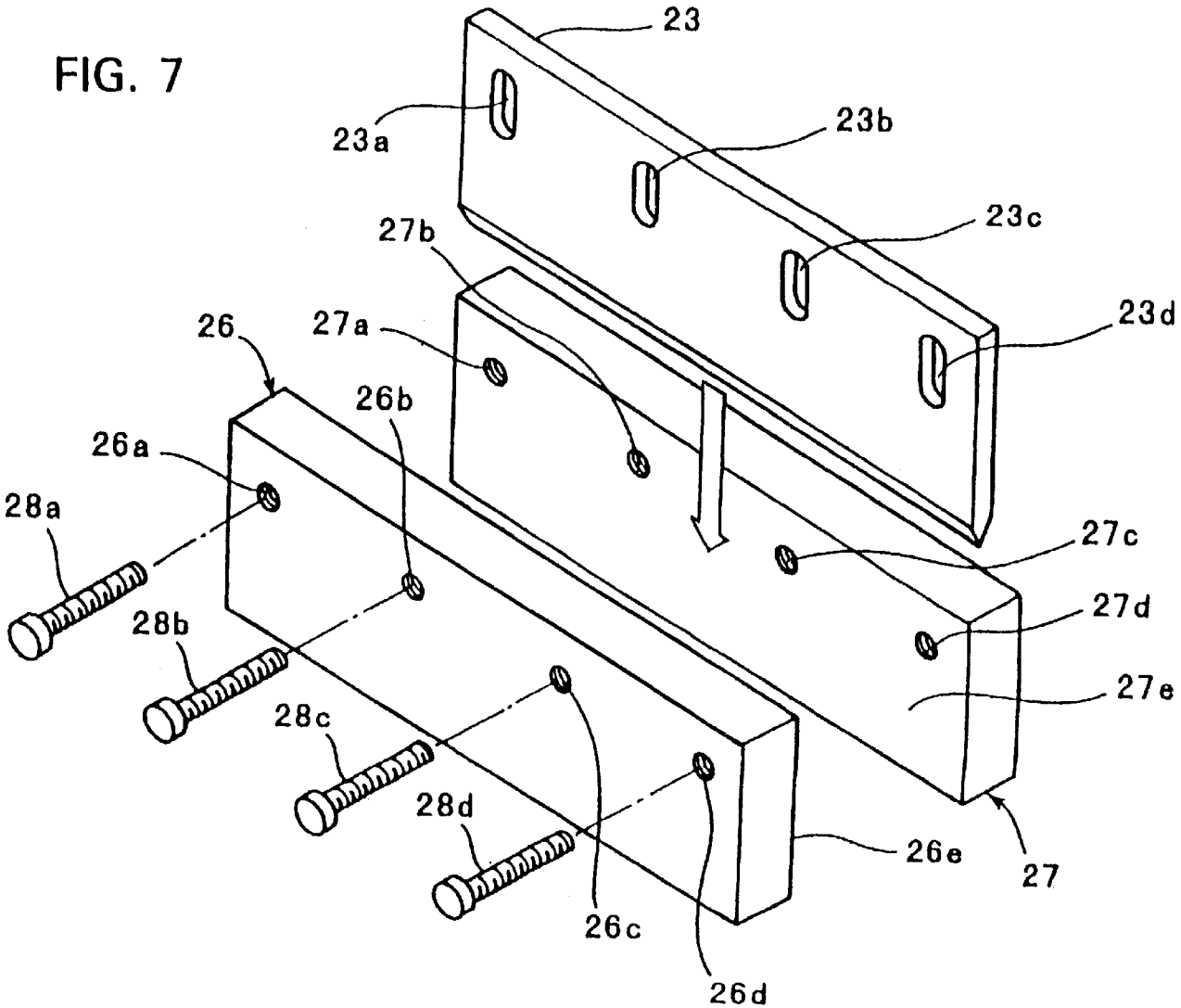
FIG. 7 is a schematic perspective view showing a variant example of the structure in which a cutting blade and a pair of guides are installed.

In FIG. 7, there is shown another variant example of guides in the form of an exploded perspective view. In guides 26 and 27, screw holes 26*a*–26*d* and 27*a*–27*d* are formed, respectively. Slot-shaped through holes 23*a*–23*d* which extend in the vertical direction are formed at corresponding locations in the cutting blade 23 disposed between the guides 26 and 27.

In this variant example, coupling screws 28*a*–28*d* are inserted into the screw holes 26*a*–26*d*, 27*a*–27*d*, and the through holes 23*a*–23*d*. Using the coupling screws 28*a*–28*d*, therefore, the clearance between the guide faces 26*e* and 27*e* of the guides 26 and 27, and the cutting blade can be adjusted to a suitable amount. Although the coupling screws 28*a*–28*d* pass through the through holes 23*a*–23*d* of the cutting blade 3, the cutting blade 3 can be moved in the longitudinal direction of the through holes 23*a*–23*d*, that is, vertically, independently of the guides 26 and 27, since the through holes 23*a*–23*d* have a slot-like shape. The cutting blade 3 is fixed to the holder (not shown) at the upper end thereof.

Figure 8:
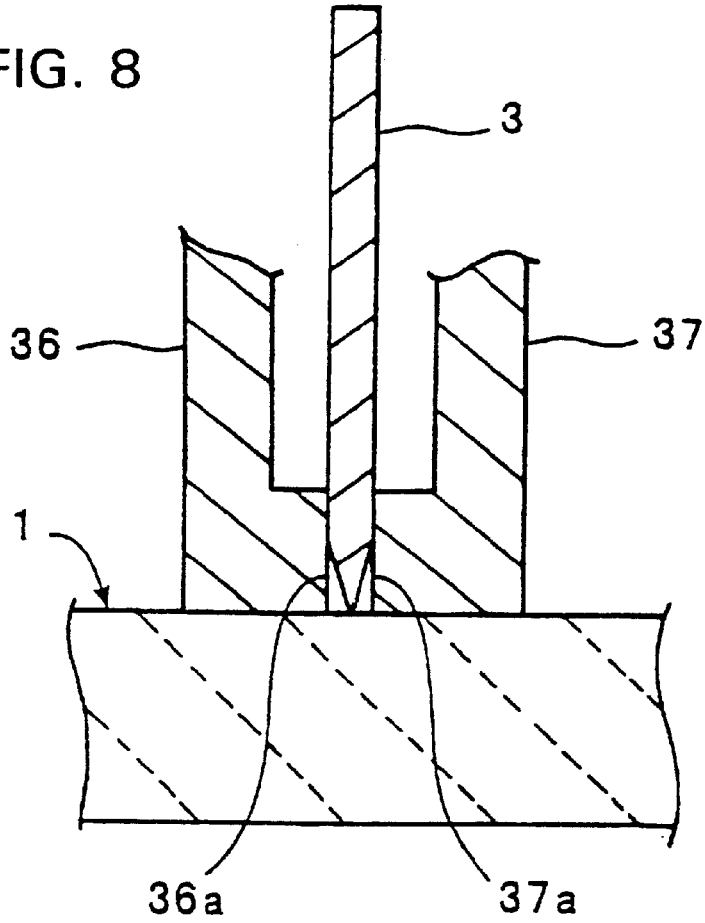
FIG. 8 is a partially cutaway sectional view for explaining a variant example of guides.

In the cutting device in accordance with the first embodiment of the present invention, the guides 6 and 7 have a square-bar shape, and form the respective guide faces 6*a* and 7*a* in one side thereof. However, any suitable shape may be used. For example, as shown in FIG. 8, guides 36 and 37 having, at their lower ends, respective guide faces 36*a* and 37*a* protruding toward the cutting blade 3, may be used. The guide faces 36*a* and 37*a* need not be constructed with their entire sides facing the cutting blade 3.

Figure 9:
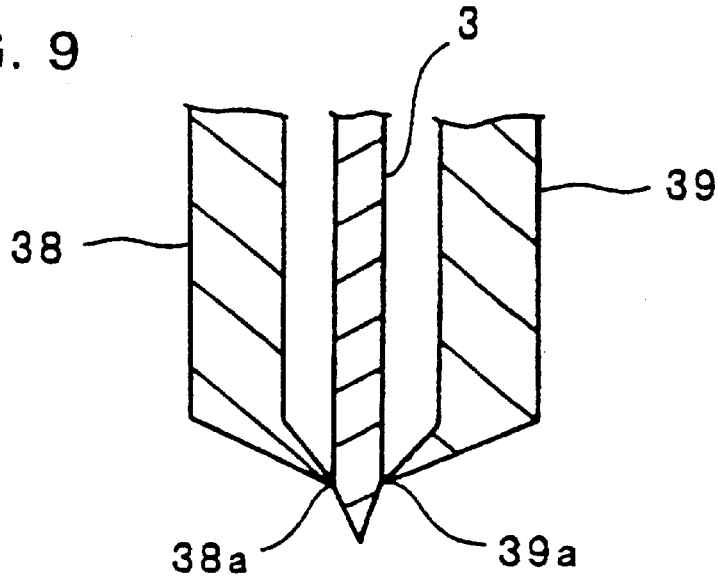
FIG. 9 is a partially cutaway sectional view for explaining another variant example of guides.
Figure 10:
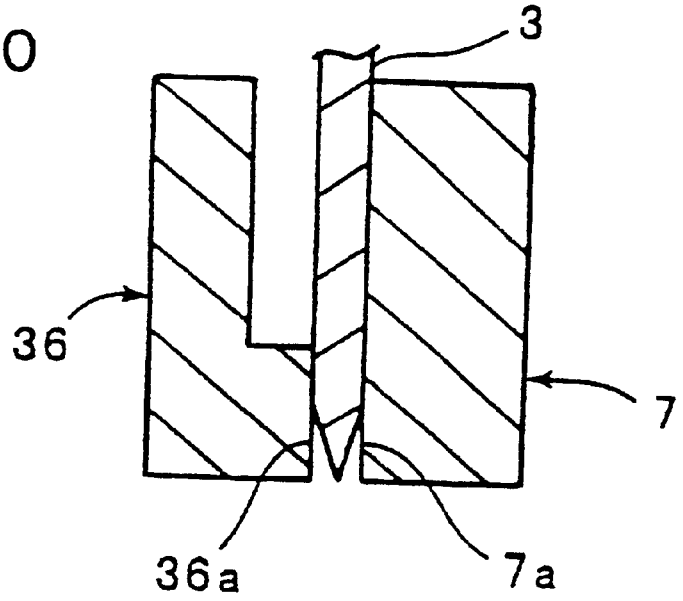
FIG. 10 is a partially cutaway sectional view for explaining still another variant example of a pair of guides.

As shown in FIG. 9, guides 38 and 39 having the guide faces which approach or contact the sides of the cutting blade 3 point-contact-wise or line-contact-wise, may also be employed. By way of further example, the guide 36 shown in FIG. 8 and the guide 7 shown in FIG. 1 may be used in combination as shown in FIG. 10.

Figure 11:
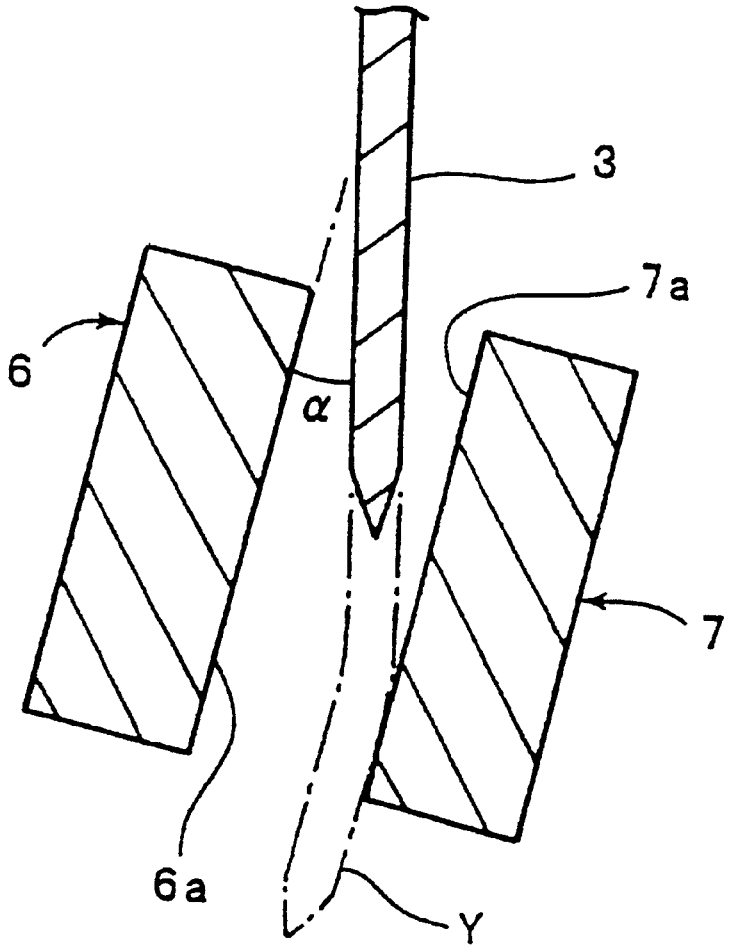
FIG. 11 is a partially cutaway sectional view showing another variant example of a pair of guides of which guide faces are tilted.
Figure 12:
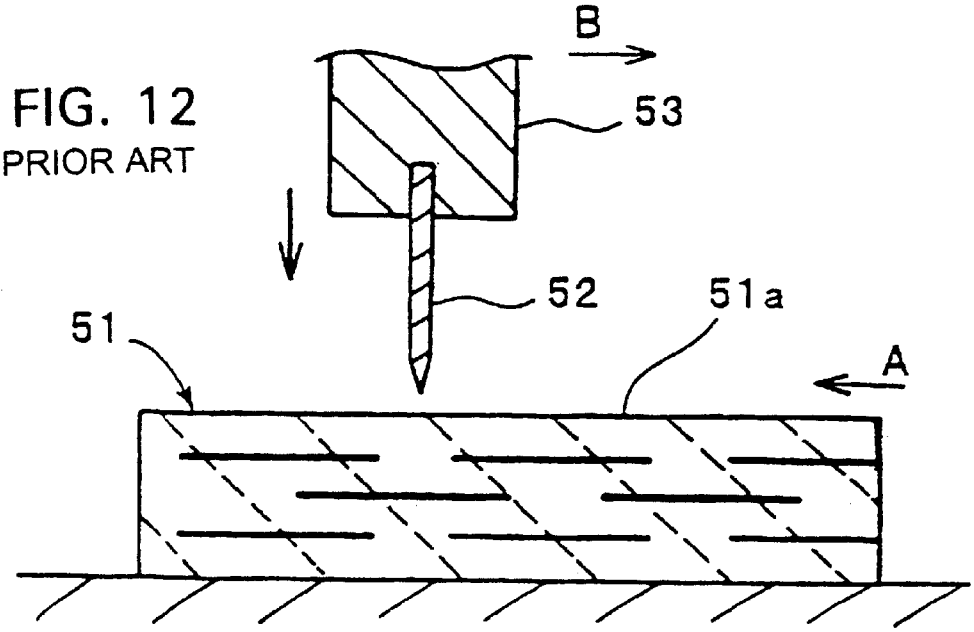
FIG. 12 PRIOR ART
FIG. 12 is a cross sectional view for explaining the conventional cutting method for a ceramic laminate.
Figure 13:
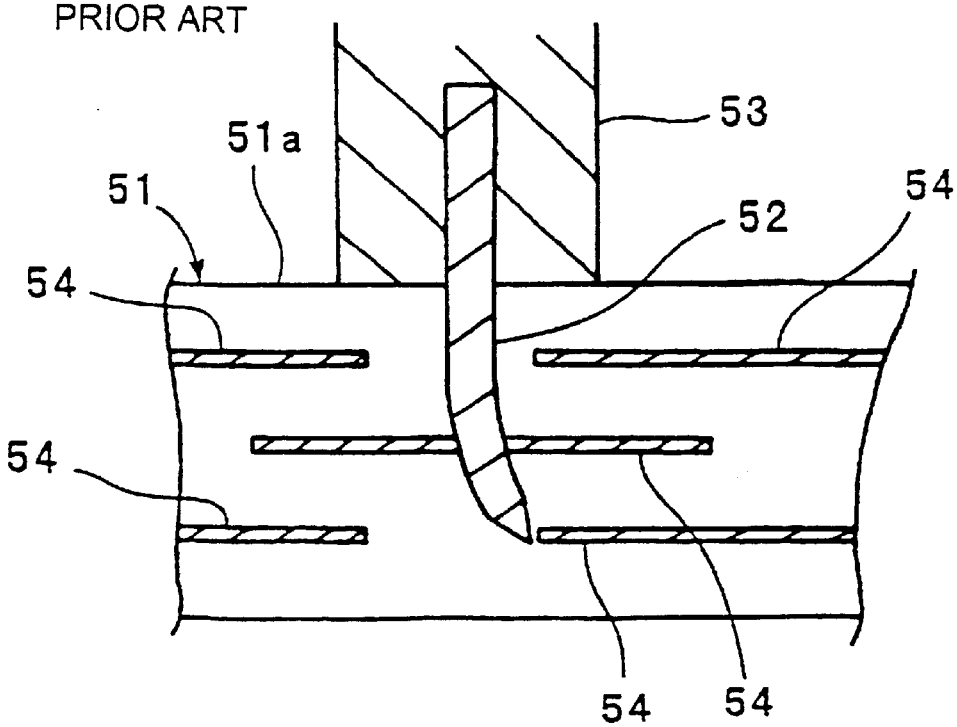
FIG. 13 PRIOR ART
FIG. 13 is a partially cutaway sectional view for explaining a problem in the conventional cutting method for a ceramic laminate.

Moreover, as shown in FIG. 11, the guides 6 and 7 may be tilted. In the construction shown in FIG. 11, the guide face 6*a* is tilted so as to form a tilting angle relative to the moving direction of the cutting blade 3, that is, the thickness direction of the ceramic laminate. Since the guide face 7*a* is parallel to the guide face 6*a*, the guide face 7*a* is also tilted so as to form a tilting angle relative to the thickness direction of the ceramic laminate.

When the cutting blade 3 is moved downwardly, it is in contact with the guide face 7a, so that the cutting blade 3 enters the mother ceramic laminate 1 at an angle, as shown by a chain line Y in FIG. 11. The mother ceramic laminate, therefore, can be cut at an angle.

Thus, when it is necessary to cut the mother ceramic laminate 1 at an angle, the guide faces 6*a* and 7*a* of the guide 6 and 7 may be tilted from the direction orthogonal to the principal plane la (FIG. 1) of the mother ceramic laminate 1.

The above-mentioned tilting angle is not particularly limited. By way of example, by tilting the cutting blade about 0.5 to 2, a cut face tilted about 0.5 to 2 relative to the thickness direction can be constituted in cutting the mother monolithic ceramic body 1.

The pair of guides mentioned above may be reliably brought in contact with the sides of the cutting blade by forming at least one guide as a magnet and using the guide with a cutting blade made of a paramagnetic material such as iron or stainless steel which is attracted to the magnet.

In the above-described embodiment, although the manufacturing method for a monolithic capacitor has been described, it should be noted that the present invention can generally be also applied to the manufacture of monolithic ceramic electronic parts other than a monolithic capacitor, or monolithic ceramic parts other than electronic parts.

Also, in the above-described embodiment, although the guides 6 and 7 disposed on opposite sides of the cutting blade 3 are constructed of individual bodies, a one-piece guide which can pinch the cutting blade and which has, for example, a slit may be used.

In the manufacturing method for a monolithic ceramic part in accordance with the present invention, a mother ceramic laminate is cut with the cutting blade in the state that the guides are disposed on opposite sides of the cutting blade in the vicinity of the one principal plane. Since the cutting direction, therefore, is controlled by the guides in cutting, even a thick ceramic laminate can be cut quickly and stably.

By firing individual ceramic laminates obtained by cutting, therefore, desired monolithic ceramic parts with a high accuracy can be obtained.

In the case where cutting is performed while the guides abut the one principal plane of the mother ceramic laminate, not only is the cutting direction is controlled, but the portion to be cut is kept stable by the guides, with the result that cutting can be performed more quickly and stably.

In the case where the cutting blade is detached from the ceramic laminate while the guides abut the one principal plane of the mother ceramic laminate, it is possible to effectively suppress the phenomenon that ceramic adheres to the cutting blade or the peeling-off of layers of ceramic laminate.

When cutting is performed with a small clearance provided between the guides and the cutting blade, rubbing resistance between the cutting blade and the guides can be reduced, which permits a faster cutting.

The guides may have tilting guide faces relative to the sides of the cutting blade so that the mother ceramic laminate is cut in at an angle with respect to the thickness direction of the mother ceramic laminate.

In the cutting device for use in cutting a ceramic laminate in accordance with the present invention, since there are provided guides disposed on opposite sides of the cutting blade in the vicinity of the ceramic laminate, and the guides control the direction that the cutting blade enters the ceramic laminate, even a thick ceramic laminate can be cut stably and at a fast rate.

When first actuators are connected to the guides to move at least one of the guides toward the cutting blade, it is possible to bring the guides either into contact with the cutting blade, or to create a predetermined clearance between the guides and the cutting blade, by driving the first actuators.

When the second actuators are installed on the lower surface of the base member, and the guides can be vertically moved by the second actuators independently of the base member, cutting can be performed by lowering the cutting blade by lowering of the base member, and by further lowering the cutting blade 3 while keeping the guides abutted against the planar principal surface of the ceramic laminate.

After cutting, the cutting blade can be detached from the mother ceramic laminate while maintaining the lower surface of the guides abutted against the principal surface of the mother ceramic laminate.

Where the guides have guide faces to control the cutting direction, and the guide faces are tilted relative to the direction of thickness of the ceramic laminate, the ceramic laminate can be cut at a slant since the cutting blade enters the ceramic laminate at an angle relative to the thickness direction of the ceramic laminate.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for manufacturing a monolithic ceramic part, said method comprising:

preparing an unfired mother ceramic laminate;

dividing said mother ceramic laminate into individual laminates of monolithic ceramic part units by cutting said mother ceramic laminate with a cutting blade extending through guides disposed on opposite sides of said cutting blade and located in the vicinity of one planar principal surface of said mother ceramic laminate to control the cutting direction of said blade; and firing said individual ceramic laminates obtained by said cutting operation.

2. A method for manufacturing a monolithic ceramic part according to claim 1, wherein said cutting is performed while keeping said guides abutted against said planar principal surface of said mother ceramic laminate.

3. A method for manufacturing a monolithic ceramic part according to claim 2, further comprising detaching said cutting blade from said mother ceramic laminate after said cutting while keeping said guides abutted against said planar principal surface of said mother ceramic laminate.

4. A method for manufacturing a monolithic ceramic part according to claim 1, wherein cutting is performed with a clearance provided between said guides and said cutting blade.

5. A method for manufacturing a monolithic ceramic part according to claim 4, further comprising detaching said cutting blade from said mother ceramic laminate after said cutting while keeping said guides abutted against said planar principal surface of said mother ceramic laminate.

6. A method for manufacturing a monolithic ceramic part according to claim 1, wherein said guides have guide faces tilted relative to sides of said cutting blade and wherein said cutting is carried out with said cutting blade in contact with said guide faces such that said cutting direction is not orthogonal to said planar principal surface of said mother ceramic laminate.

7. A method for manufacturing a monolithic ceramic part according to claim 1, wherein one of said guides has guide faces tilted relative to sides of said cutting blade and wherein said cutting is carried out with said cutting blade in contact with said guide faces such that said cutting direction is not orthogonal to said planar principal surface of said mother ceramic laminate.

8. A method for manufacturing a monolithic ceramic part according to claim 3, wherein said guides have guide faces tilted relative to sides of said cutting blade such that said cutting direction is not orthogonal to said planar principal surface of said mother ceramic laminate.

9. A cutting device for cutting a ceramic laminate, comprising:

a cutting blade;

a drive connected to said cutting blade so as to move said cutting blade in a thickness direction of said ceramic laminate for cutting said ceramic laminate in said thickness direction thereof; and guides disposed on opposite sides of said cutting blade in the vicinity of said ceramic laminate for controlling the direction that said cutting blade enters said ceramic laminate.

10. A cutting device for use in cutting a ceramic laminate according to claim 9, further comprising a first actuator connected to a first one of said guides for moving said first one of said guides toward said cutting blade.

11. A cutting device for use in cutting a ceramic laminate, further comprising a second actuator connected to a second one of said guides for moving said second one of said guides toward said cutting blade.

12. A cutting device for use in a ceramic laminate according to claim 9, further comprising:

a base member having a lower surface, said cutting blade being fixed to said lower surface; said base member being moved in upper and lower directions by said drive; and second actuators coupled to said lower surface of said base member and connected to said guides so as to move said guides in said upper and lower directions independently of said base member.

13. A cutting device for use in a ceramic laminate according to claim 10, further comprising:

a base member having a lower surface, said cutting blade being fixed to said lower surface; said base member being moved in upper and lower directions by said drive; and second actuators coupled to said lower surface of said base member and connected to said guides so as to move said guides in said upper and lower directions independently of said base member.

14. A cutting device for use in a ceramic laminate according to claim 11, further comprising:

a base member having a lower surface, said cutting blade being fixed to said lower surface; said base member being moved in upper and lower directions by said drive; and second actuators coupled to said lower surface of said base member and connected to said guides so as to move said guides in said upper and lower directions independently of said base member.

15. A cutting device for use in a ceramic laminate according to claim 9, wherein:

said guides each have a guide face for controlling said cutting direction of said cutting blade; and said guide faces are tilted relative to said thickness direction of said ceramic laminate, for cutting said ceramic laminate at an angle relative to said thickness direction.

16. A cutting device for use in a ceramic laminate according to claim 10, wherein:

said guides each have a guide face for controlling said cutting direction of said cutting blade; and said guide faces are tilted relative to said thickness direction of said ceramic laminate, for cutting said ceramic laminate at an angle relative to said thickness direction.

17. A cutting device for use in a ceramic laminate according to claim 11, wherein:

said guides each have a guide face for controlling said cutting direction of said cutting blade; and said guide faces are tilted relative to said thickness direction of said ceramic laminate, for cutting said ceramic laminate at an angle relative to said thickness direction.

18. A cutting device for use in a ceramic laminate according to claim 12, wherein:

said guides each have a guide face for controlling said cutting direction of said cutting blade; and said guide faces are tilted relative to said thickness direction of said ceramic laminate, for cutting said ceramic laminate at an angle relative to said thickness direction.

* * * * *